United States Patent [19]

Asaka

[11] Patent Number: 4,479,287

[45] Date of Patent: Oct. 30, 1984

[54] EYE HOLE FOR ROPING REINFORCED BY GROMMET METAL FITTINGS AS IN SHEET-LIKE ARTICLES

[76] Inventor: Hitoshi Asaka, 18-24, Takada-cho, Ibaraski-shi, Osaka 567, Japan

[21] Appl. No.: 361,896

[22] Filed: Mar. 25, 1982

[30] Foreign Application Priority Data

May 10, 1981 [JP] Japan ..... 56-159311
Oct. 24, 1981 [JP] Japan ..... 56-170297

[51] Int. Cl.[3] ..... A43C 5/00; A43D 100/00

[52] U.S. Cl. ..... 24/141; 16/2; 114/114

[58] Field of Search ..... 24/141, 202; 16/2; D8/356; 114/114, 115; 2/265

[56] References Cited

U.S. PATENT DOCUMENTS

| | | | |
|---|---|---|---|
| 92,199 | 7/1869 | Mair | 24/141 |
| 2,101,060 | 12/1937 | Grookin | 24/141 |
| 2,221,120 | 11/1940 | Valentine | 24/141 |
| 2,553,051 | 5/1951 | Kingman | 24/141 |
| 2,562,005 | 7/1951 | Wenzel et al. | 24/141 |
| 2,901,800 | 9/1959 | Koell | 24/141 |
| 3,328,854 | 7/1967 | Tombari | 24/141 |

*Primary Examiner*—Gene Mancene
*Assistant Examiner*—John G. Weiss
*Attorney, Agent, or Firm*—Darby & Darby

[57] ABSTRACT

In reinforcing an eye hole for roping of a sheet-like article by setting grommet metal fittings therein, there is formed an incised hole nearly equal in diameter to the outer diameter of the cylindrical portion of a male grommet, and the tongues covering the incised hole, which are made through a process of radially incising at a position where the eye hole for roping is to be provided on the sheet body, in place of a circular through-hole heretofore in use. Each of the tongues and the peripheral region of the incised hole are pressed together while being enfolded by the grommet metal fittings being depress-deformed through a suitable means, thereby leading to reliably and strongly setting of the grommet metal fittings and increasing the tensile strength of the eye hole for roping. According to this invention, the use of one male grommet by itself will suffice as a grommet metal fitting; it is also feasible to reinforce the eye hole for roping in the sheet body of thick cloth or the multiple-ply cloth through the joint use of a male grommet and a ring or male and female grommets.

6 Claims, 18 Drawing Figures

FIG. 8
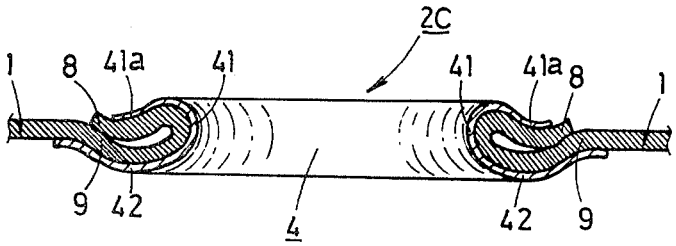
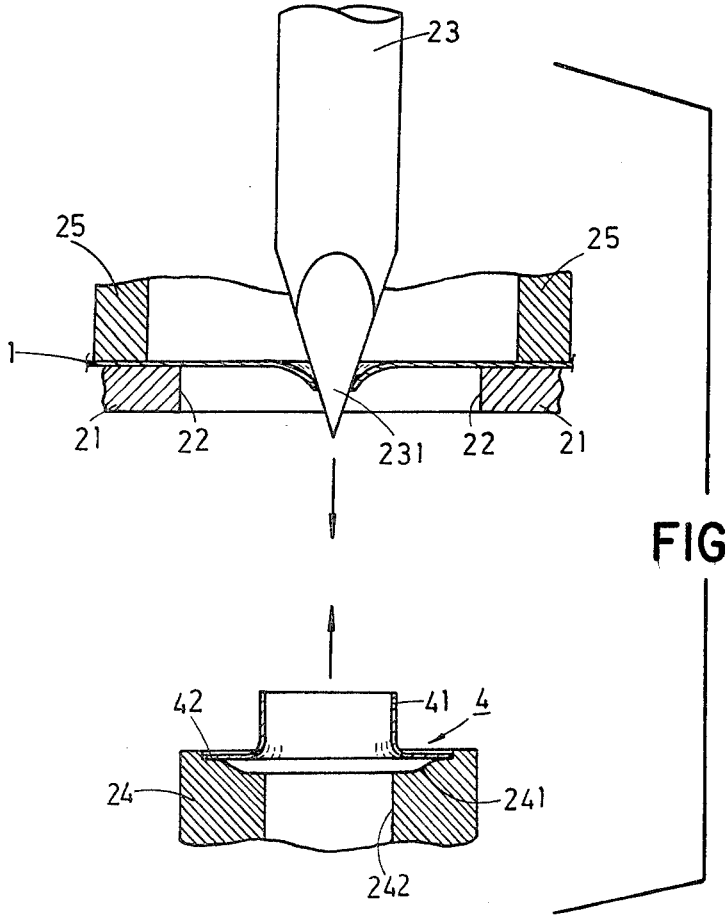
FIG. 9(a)

EYE HOLE FOR ROPING REINFORCED BY GROMMET METAL FITTINGS AS IN SHEET-LIKE ARTICLES

BACKGROUND OF INVENTION

This invention relates to the structure of an eye hole for roping reinforced by grommet metal fittings as in sheet-like articles, and is more particularly related to an eye hole for roping. The hole is reinforced in such a sequence that first an incised hole covered with a plurality of tongues created by radially incising the sheet-like material is made in a part of the sheet. A male grommet is inserted through the incised hole, and the tongues and the peripheral region of the incised hole are doubled over along the outer circumference of the inserted male grommet and both are pressed together while being enfolded by the male grommet by itself or between the male grommet and a female grommet or between the male grommet and a ring. Thus, the single male grommet, or the male grommet and the female grommet or the male grommet and the ring are securely fixed on the sheet body.

In this connection, the term "sheet-like articles" shall mean finished goods made of various kinds of "sheet-like materials", for example, canvas and other fabrics, cloths impregnated or coated with rubber or plastics, leathers, plastic film or sheet reinforced with thread or cloth, knitted or braided goods, netted fabric of close texture, thick pieces of plastic film or sheet, and others. As for the term "eye hole for roping", it shall mean a hole through or on which a rope of hemp, cotton or wire, small-gauge cord, and the like are passed or fitted, inclusive of a metal clasp hole through or on which a hook or stop fittings are passed or hung.

As a rule, a sheet body structure such as a tent, hood, covering, curtain, and such need several holes therein through which ropes, cords, etc. of hemp, cotton or wire pass which are used at the time the sheet body structure is set up. In the same way, sheet body formations such as rucksacks, bags, waist belts and the like which are formed of canvas, leather, reinforced plastic sheet and so on, are normally provided with holes through or on which ropes or buckles are passed or fitted. Such holes referred to here as eye holes for roping are usually reinforced by grommet metal fittings which line these holes.

The process widely used heretofore for reinforcing the eye hole for roping is as shown in FIG. 1, that is, first a circular through-hole (3) is formed by punching in the predetermined position of the eye hole (12A) for roping to be set in the sheet body (1), next the cylindrical portion (41) of the male grommet (4) is inserted into the through-hole (3), then the female grommet (5) is disposed onto the male grommet (4) from the reverse side of the sheet body (1), and lastly the female grommet (5) is tightly fastened and protected from falling off by the upper part **(41*a*) of the cylindrical portion(41) of the male grommet (4), which upper part (41*a*)** expands open and then turns down and inwards.

The grommet metal fittings not only perform the function of protecting the sheet body from fraying, further giving a sense of beauty or stability, but also impose an effective check on the enlargement of the hole and prevent the sheet body from tearing when a tensile force is applied to a rope which passes through the eye hole. In conventional articles, however, both the male grommet (4) and the female grommet (5) hold only the peripheral region of the through-hole (3) between themselves, and are simply attached to the region of the through-hole. Accordingly, when a large amount of force is applied to the rope, this force is applied only to the side of the through-hole placed under tension, and as a result, the grommet metal fittings often fall off due to tearing of the through-hole or the enlargement of the through-hole itself.

Furthermore, the above-mentioned defect is accelerated if during manufacture, the through-hole is made large in order to make the grommet-setting job easy to perform or for purposes of automation. In such a situation, various measures have been taken, for example, by strengthening the peripheral region surrounding the eye hole (2A) with the sheet body member being folded doubly or trebly, by increasing the number of eye holes with the object of dispersing the tension and by enlarging the breadth of the flange portion (42) of the male grommet or magnifying the size of the outer diameter of the female grommet in order to prevent these grommet metal fittings from falling off. These measures have had little effect in proportion to the trouble and expense needed to implement them. Additionally, the waste produced at the time of punching the holes in the sheet body often eats into the edge of the hole which tends to lead to the inferiority of punching, thereby causing various problems in the automation of punching the holes into the sheet body and setting the grommet therein.

Many structures comprised of sheet-like materials of various kinds, for example, warehouses, gymnasiums, pavilions, and the like have been constructed. The eye holes used in such constructions are required to have great tensile strength since these structures must be resistant to both their own weight and also to the large wind pressure to which they are subjected. Additionally, the eye holes must have durability equal to the sheet-like materials used (common canvas, plastic-coated canvas, or others) which have become physically stronger and more durable. It is almost impossible for an eye hole prepared according to the prior art, however, to meet the foregoing requirements.

On the other hand, it was impractical up to this time to provide eye holes for roping directly on stretchy articles comprised of for example webs of rough texture or knittings, jute-woven packing sheets, grain bags, sundry goods of victoria lawn or mosquito net cloth, and others, since the through-holes prepared on such articles readily become enlarged by tension. As a countermeasure, these holes are reinforced by taking advantage of some cloth as strong as possible in preparing for the eye holes, otherwise, referring to the bags in particular, there was no alternative but to form the through-holes for roping by folding back about the opening part of the bag. This is a troublesome and expensive job.

SUMMARY OF THE INVENTION

According to the present invention, a piece of cloth at the place through which the male grommet is to be inserted is left as several tongues without punching away, and after that these tongues are rolled in and turned down in the inward direction together with the peripheral region of the through-hole of the sheet body.

The object of this invention is to provide eye holes for roping in sheet materials which are of high tensile strength and durability. It is a further object of this invention to provide for the fabrication of reinforced eye holes of sheet bodies by the use of male grommets only, or with the joint use of rings in combination with male grommets with respect to such kinds of sheet bodies as thick cloth or several sheet bodies overlapped one over the other, and further the formation of eye holes suitable for use relative to such articles as fabrics of thin or rough texture, stretchy knittings, leather, plastics and others, as the case may be.

A further object of this invention is to provide various kinds of sheet bodies equipped with such eye holes for roping made securely and easily reinforced through the automation of the setting of the grommets.

BRIEF DESCRIPTION OF THE DRAWINGS

FIG. 8 is a longitudinal sectional view in part of the reinforced eye hole for roping which is formed according to FIG. 7(*b*);

DETAILED DESCRIPTION OF PREFERRED EMBODIMENTS

Figure 1:
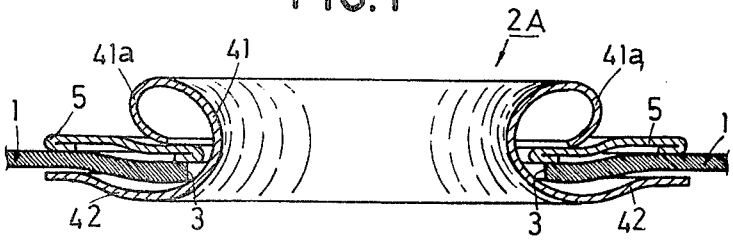
FIG. 1 is a longitudinal sectional view in part of an eye hole for roping which is reinforced by setting a conventional metal grommet on a sheet body according to the prior art.

The present invention will now be described more particularly on the basis of the examples shown in the drawings.

Figure 2:
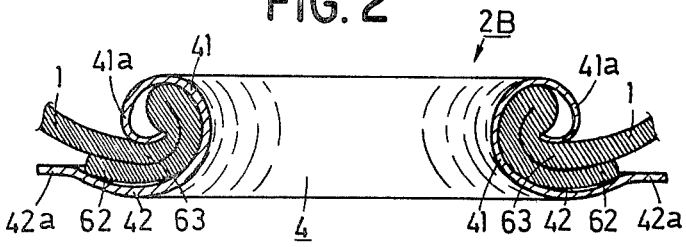
FIG. 2 is a longitudinal sectional view in part of an eye hole for roping reinforced according to the present invention.
Figure 3:
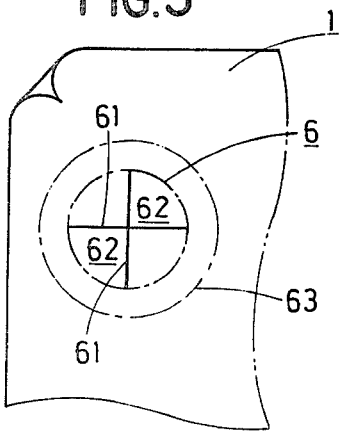
FIG. 3 is a plan view showing crosswise incisions on a sheet body.

Refer to FIGS. 2 and 3. FIG. 2 is a longitudinal sectional view in part of reinforced eye hole for roping (2B) showing a preferred example of the invention. This eye hole is formed in a sequence wherein first an incised hole (6) having a diameter nearly equal to the outer diameter of the cylindrical portion (41) of a male grommet (4) is made by radial incisions (61) in the position where the eye hole for roping is to be provided on a sheet body (1), as shown in FIG. 3. Second, the cylindrical portion (41) of male grommet (4) is inserted through the incised hole (6) in the state where each of four tongues (62) are bent to the side of a flange portion (42) of the male grommet (4). Lastly, all four tongues (62) and the peripheral region (63) of the incised hole (6) are enfolded together and crimped between the expanded and then turned-down-inwardly upper part (41*a*) of the cylindrical portion (41), the expanded and curved middle part thereof, and the edge of the flange portion (42), respectively, of the male grommet (4), thus securely fixing the male grommet (4) on the sheet body (1).

In this connection, referring to the number of the tongues (62) in the incised hole (6), that is, the number of the incisions (61), four pieces or four cuts are seen in FIG. 3. It will be clear to those skilled in the art that this number may vary and will ordinarily be between two and ten. In order to secure the enfoldment of the tongues (62) together with the peripheral region (63) of the incised hole (6) and to firmly fix the grommet on the sheet body, it is preferred that the number of tongues or cuts be rather few, for example, about two to ten.

The example given in FIG. 2 is characterized in that the reinforced eye hole for roping is light in weight and low in cost since only a male grommet (4) is used as the grommet metal fitting, and that the expansion, turning down, and compressive deformation of the upper part (41*a*) of the cylindrical portion of the male grommet can be developed fully since, a female grommet as shown in FIG. 1, is not used. Thus the tongues (63) and the peripheral region (63) of the incised hole (6) are clamped thoroughly between the upper part (41*a*) of the cylindrical portion (41), the middle part thereof, and the flange portion (42), respectively, of the male grommet, while the rolling up of the tongues (62), more particularly their root parts, and the peripheral region (63) of the hole up to the upper part (41*a*) of the cylindrical portion (41) is also accomplished. The affixation of the grommet to the sheet body is thus carried out completely.

Figure 4A:
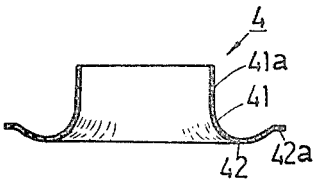
FIG. 4(*a*) and (*b*) are longitudinal sectional views of two different male grommets, respectively, of which (a) shows a conventional grommet and (b) an improved grommet having no outside ring on the edge of its flange part.
Figure 4B:
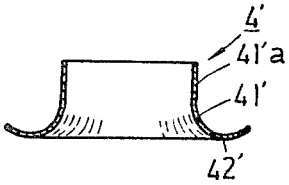

The male grommet (4) used in the above example (FIG. 2) is the same as that shown in FIG. 4(*a*). In the reinforced eye hole (2B'), however, a male grommet (4') is used which is formed by removing the projecting annular flat part (42*a*) of the flange portion (42) of the above-mentioned male grommet (4) which thus has a remaining narrow flange portion (42') (FIG. 4(*b*)). The expanded and turned-down upper part (41'*a*) of the cylindrical portion fully fits into the flange portion (42'), in consequence of which the clasped condition of the sheet body (1) is served.

Figure 5:
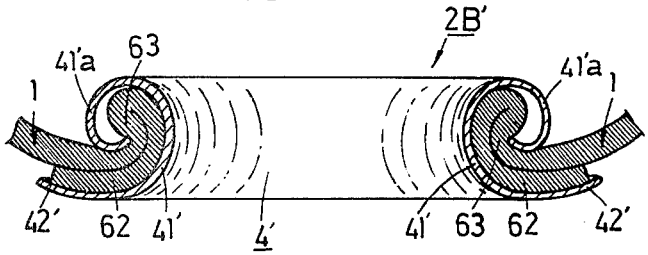
FIGS. 5 and 6 both show another example of a reinforced eye hole for roping, the former being a longitudinal view thereof and the latter illustrating an example of how to set the grommet.
Figure 6:
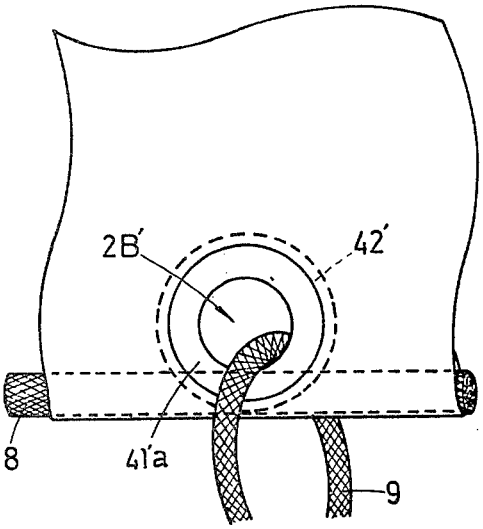

Furthermore, the male grommet (4') becomes smaller since much of the outer annular part is taken away and accordingly the production costs decrease. Also, this male grommet can be set in the position nearest to the outer edge of the sheet body (1), as seen in FIG. 5, so that it is possible to locate the cylindrical portion (41') nearly contacting a rope (8) reinforcing the fringe of the sheet body. As a result the tensile force of a rope (9) hanging on the inner circumference of the cylindrical portion (41'), that is, the eye hole (2B), is substantially the same as if it was bearing on the rope (8); reinforcing the edge of the sheet body in this way makes it possible to distribute the tensile force. In this connection it may be remarked that in any of the male grommets (4), (4'), it is preferable to make the length of their cylindrical portion according to the thickness or the number of layers of enfoldment of the sheet body, or by making the thickness of the walls of the male grommets thicker than the conventional ones in order to increase their strength.

Figure 7B:
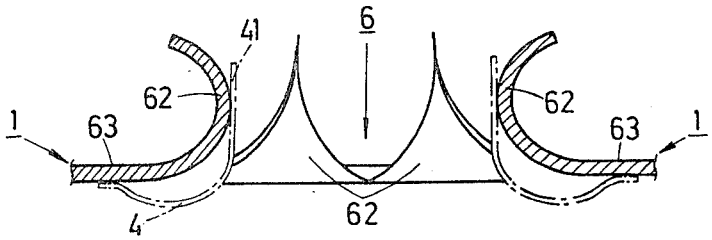
FIG. 7(*a*) and (*b*) are longitudinal sectional views, showing how to insert a male grommet into an incised hole.
Figure 7A:
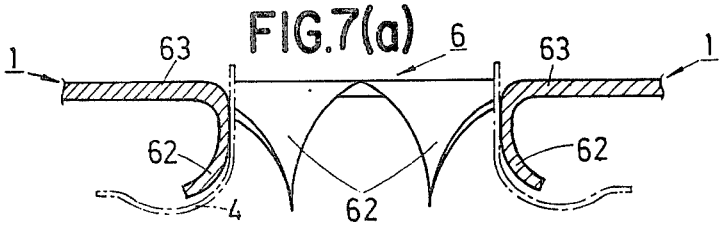

The reinforced eye hole (2B) related to the aforesaid example (FIG. 2)—this is also the case with (2B') in FIG. 5—attainable by striking the upper part (41*a*) of the cylindrical portion of the male grommet (4) which has been inserted into the above-mentioned incised hole (6) shown in FIG. 3 in the state of FIG. 7(*a*), with a hand-operated punch(not shown) until the very upper part (41*a*) expands and then turns down. On the other hand, when the bending direction of each of tongues (62) is made to correspond to the inserting direction of the male grommet (4), as shown in FIG. 7(*b*), such a reinforced eye hole (2C) as seen in FIG. 8 can be obtained. This reinforced eye hole (2C) of FIG. 8 is relatively easy to make manually with the aid of a punch, but the enfoldment of the tongues (62) to the upper part (41*a*) of the cylindrical portion is only executed so that the eye hole thus fabricated is slightly inferior in strength and consequently causes the tongues to protrude from within the grommet to the outside, making a less neat presentation.

The eye hole formed on the system of FIG. 7(2), although more difficult to be done manually, is superior in strength and attractive. Furthermore, it becomes possible on this system to set the grommet without a break in the formation of the incised hole (6) and the setting-fixing operation of the eyelet metal. This may now be done in one operation with the help of such a special fabricating device (20) as shown in FIG. 9 (diagram of the working principle).

The fabricating device (20) of this type is made up of a table (21) on which the sheet body (1) is held, a circular hole (22) bored through the table (21), a guide bar (23) and a grommet-supporting member (24) each being located on the upper side and lower side of the circular hole(22), and a sheet bodykeeping member (25) which may be moved up and down on the upper side of the table (21), and a driving device (not shown) for (23, (24) and (25).

Figure 9B:
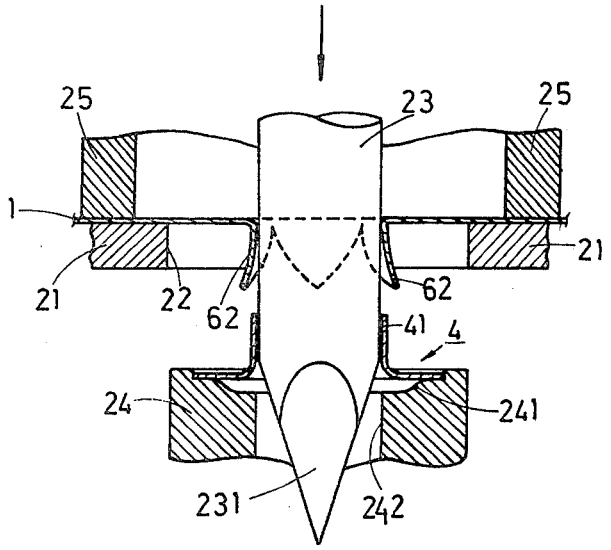
FIG. 9(*a*), (*b*) and (*c*) are explanatory diagrams to illustrate the working principle of the device on which the reinforced eye hole according to the invention is formed in accordance to FIG. 7(*a*)
Figure 9C:
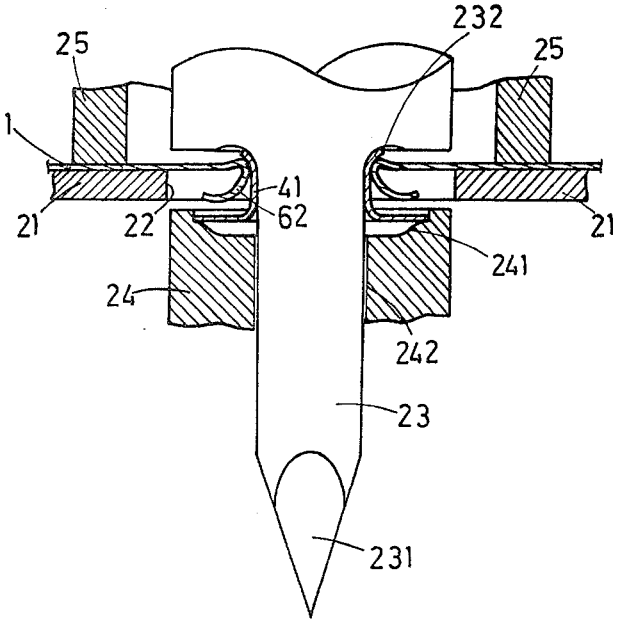

In use, after fixing the sheet body (1) which is mounted on the table (21) in position by the use of the sheet bodykeeping member (25), the guide bar (23) is lowered giving the sheet body (1) the radial incision with the cutter (231) which is attached to the pointed end of the guide bar (23) (FIG. 9(*a*)). Concurrently, the grommet-supporting member (24) is raised when the cutter (23) pierces through the cylindrical portion (41) of the male grommet which is held on the top part (241) of the grommet-supporting member (24), and is further lowered through the inner hole (242) thereof (FIG. 9(*b*)). The lowering of the guide bar (23) and the raising of the grommet-supporting member (24) continue further, in the course of which the cylindrical portion (41) of the male grommet (4) comes to be inserted between the descending guide bar (23) and the tongues (62) being turned downward, and then the upper part (41*a*) of the cylindrical portion (41) is expanded and turned from side downward with the aid of a caulking groove (232) on the top part of the guide bar (FIG. 9(*c*)). In this way, the reinforced eye holes of the kind as shown in FIGS. 2 and 5 are obtained. The use of this device (20) enables the root part of each of the tongues (62), together with the immediate peripheral region (63) of the incised hole (6) to be enfolded around and securely fixed by the upper part (41*a*) of the cylindrical portion (41) which expands and turns downward so that both of them ascend very closely along the cylindrical portion (41) of the male grommet (4) at the time of inserting the latter. This occurs since the length of the incision (61) is shorter than the outer diameter of the cylindrical portion (41) of the male grommet (4). The pointed end of each of the tongues is turned back on the flange portion of the male grommet and tucked therein, so that it is invisible from outside, resulting in a neat appearance. Additionally, the operation of incising the hole and setting the grommet is executed successively by one stroke according to this system, and thus the reinforcement of the eye hole with the grommet may be very simply put into practice.

Figure 10A:
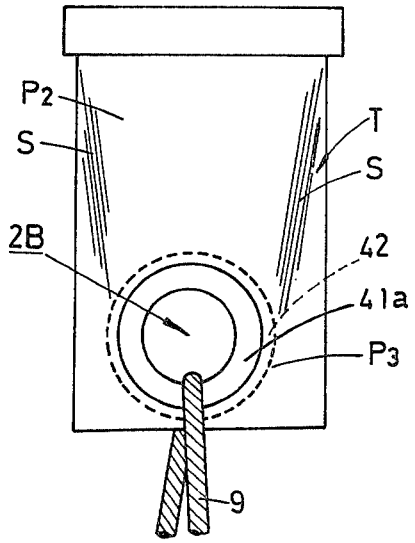
FIG. 10(*a*) and (*b*), and FIG. 11 are explanatory diagrams each illustrating methods for measuring the tensile strength of the eye holes.
Figure 10B:
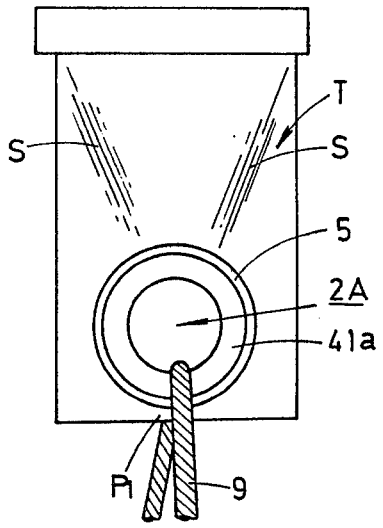
Figure 11:
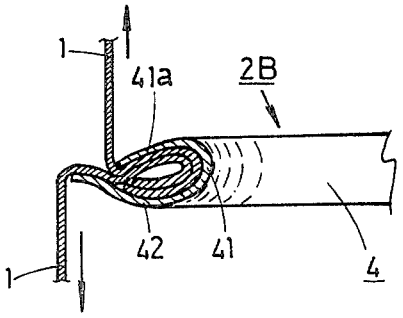

When the eye hole obtained in the above-mentioned manner, i.e. as shown by (2B) or (2B') or (2C), is tested for tensile strength, it generates approximately parallel tensile wrinkles on the test piece (T) as seen in FIG. 10(*a*), while, in the case of the eye hole (2A) formed conventionally, there occur tensile wrinkles (8) concentrating on the point $P_1$ where the rope (9) is hung as shown in FIG. 10(*b*). Thus, point $P_1$ may tear and the grommet separate from the through-hole. In contrast, in the case of the present invention, the test piece (T) starts to tear or break at the middle part ($P_2$) or at the peripheral region ($P_3$) of the eye hole, but the amount of the force applied needed to cause tearing is two or more times as much compared to the amount of force needed with conventional grommets and eye holes. Thus the invention imparts sufficient strength even to the sheet bodies made of thin cloth or rough fabric. The strength which the present invention possesses is by far greater than that of conventional eye holes composed of three to five sheets of reinforcing cloth. The reinforcement will, therefore, be used in situations where extra strength is required or where the use of the reinforcing cloth is enough with one sheet. In this connection in the case of one being equipped with the eye hole (2B) on the double-ply sheet body (1) as seen in FIG. 11, the force required to pull the two layers of the sheet body apart is three or more times as much as in the case of conventional reinforced eye holes.

In each of the examples described above (FIGS. 2, 5 and 8), although one male grommet (4) alone has been used as a reinforcing fitting, it is permissible to employ additionally some other element such as a ring or a female grommet as an auxiliary means for further tightening and fixing of the male grommet.

Figure 12:
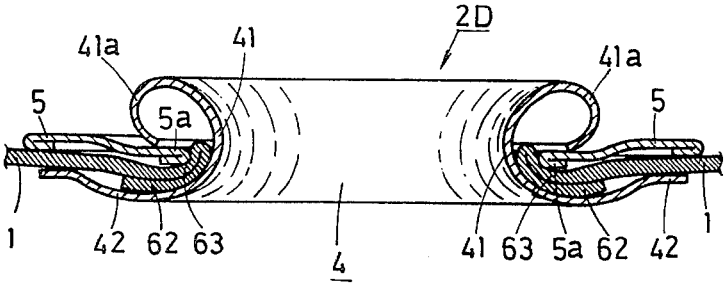
FIG. 12 is a longitudinal sectional view in part of an eye hole for roping which is reinforced by the use of both a male grommet and an female grommet.

The grommet which is used jointly with a female grommet of the type heretofore in use, however, as shown in FIG. 12, is difficult to fabricate since the enfoldment of the tongues (62) and the peripheral region (63) of the hole in the direction of the cylindrical portion (41) of the male grommet is obstructed by the inner peripheral region (5*a*) of the female grommet. In order to overcome this shortcoming, a female grommet large in inner diameter and narrow in breadth may be used. The reinforced eye hole of FIG. 12 has 1.5 or more times the tensile strength, even in its original shape, in comparison with conventional ones according to the through-hole system.

Figure 13:
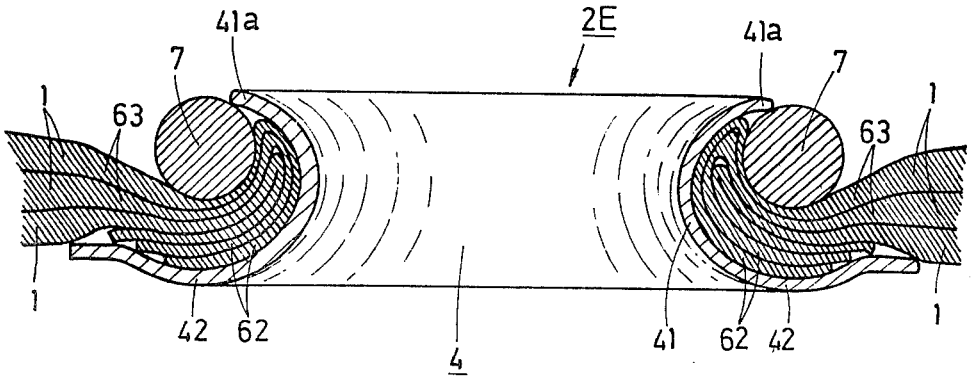
FIG. 13 is a longitudinal sectional view in part of an eye hole for roping which is reinforced by the use of a ring along with a male grommet.

In place of the above-mentioned female grommet (5), a grommet which is formed by the use of a ring (7) as an auxilliary fitting, as shown in FIG. 13, exhibits the following effect. In the case of this reinforced eye hole (2E), the ring (7) is compressed by the expanded and turned-outward upper part (41*a*) of the cylindrical portion of the male grommet, and thereby the tongues (62) together with the peripheral region (63) of the hole are enfolded between the ring (7), the flange part (42) of the male grommet, and the cylindrical portion (41) thereof, and tightened fast and fixed thereat. The ring (7) thus plays a role similar to the function of the expanded and turned-down upper part (41*a*) of the cylindrical portion of the male grommet previously shown in FIG. 2, so that the ring (7) here fully achieves its object even when the expansion and turndown of the upper part (41*a*) of the cylindrical portion would be of a low grade as in the case of a sheet body of thick cloth or of multiple-folded thin cloth. Additionally, since the ring (7) is so designed in general that more than a half of its diameter shall protrude to some extent outside from the edge of the expanded and turned-outward upper part (41*a*) of the cylindrical portion, it follows that the length of line of the pressing part of the ring (7) is longer than in the case of only the edge of the upper part of the cylindrical portion. Further, the pinching force between the pressure surface of the ring (7) and the cylindrical portion of the male grommet (4) is stronger because the cross-section of the ring (7) corresponds practically to the curved surface extending from the flange portion of the grommet through the cylindrical portion to the expanding and turned-outward upper part thereof. A result of this is that the reinforced eye hole (2E) formed in this manner develops 2.5 to 3 times the tensile strength as compared with conventional ones formed according to the throughhole system. Furthermore, the insertion of the tongues (62) together with the peripheral region (63) of the hole into the space between the inner circumference of the ring (7) and the cylindrical portion (41) of the male grommet can be performed easily and securely, and also it become possible to set the reinforcing metal fittings with certainty and steadiness even in the case of a single sheet body of thick cloth or a multiple-ply sheet body, whether it is thin or thick.

The ring (7) used in the example of FIG. 13 has a cross-section of a circular form. However, the cross-section of the ring may take any form, for example oval, or rounded, square or rectangular. The eye hole for roping formed by the use of such rings, displays a remarkable effect especially in the case of a sheet body of thick cloth or a multiple-ply sheet body. It will be clear to those skilled in the art that it can be used also in the case of a single sheet body of thin cloth.

As underatood from the above, features of this invention reside in that, in a sheet body which is to be equipped with an eyelet metal as a reinforcing means of its eye hole or fitting hole for roping, a cross-shaped incised hole nearly equal in diameter to the outer diameter of the cylindrical portion of a male grommet is bored or cut in a position where the eye hole is to be prepared in place of a circular through-hole heretofore in use. As a result there have been obtained various effects that were never shown in conventional eye holes for roping as follows:

I claim:

1. A method for fabricating reinforced eye holes with a grommet in sheet-like material, said grommet including a flange portion and a central cylindrical portion, comprising the steps of pressing in a first direction a guide bar including a cutter towards said sheet-like material to make radial incisions extending from a central point therein, said radial incisions forming a plurality of tongues substantially equal to one-half the outer diameter of said cylindrical portion of said grommet;

supporting said grommet cylindrical portion on a grommet supporting member having an aperture therein and concurrently with said step of pressing said cutter moving said grommet supporting member in a second direction opposite said first direction to receive said cutter within said aperture thereby inserting said grommet cylindrical portion amidst said tongues lying adjacent said flange portion of said grommet; and pressing an upper part of said guide bar having a groove therein to receive said flange to compress said cylindrical portion over said tongues to deform and expand said outer cylindrical portion in the said groove toward said tongues and entrap said sheet-like materials and said tongues within said deformed portion.

2. The method according to claim 1 further including the step of disposing a female grommet over said male grommet cylindrical portion prior to said pressing step, thereby entrapping said female grommet within said expanded and deformed male grommet.

3. The method according to claim 1 wherein said female grommet comprises a flat ring.

4. The method according to claim 1 further including the step of disposing a ring over said male grommet cylindrical portion prior to said pressing step, thereby entrapping said ring within said expanded and deformed male grommet.

5. The method according to claim 2 wherein said female grommet comprises a ring having a circular cross section.

6. A method according to claim 1, 2 or 3 wherein said tongues are folded to be adjacent to said flange portion of said male grommet.

* * * * *